US011851139B2

(12) United States Patent
Velilla-Chevres et al.

(10) Patent No.: US 11,851,139 B2
(45) Date of Patent: Dec. 26, 2023

(54) BODY BOARD SYSTEM AND METHOD OF USING THE SAME

(71) Applicants: Jose M. Velilla-Chevres, Dorado, PR (US); Carlos R. Benitez-Vidal, Dorado, PR (US)

(72) Inventors: Jose M. Velilla-Chevres, Dorado, PR (US); Carlos R. Benitez-Vidal, Dorado, PR (US)

(73) Assignee: WAKE FITNESS SURF CORP., Dorado, PR (US)

( * ) Notice: Subject to any disclaimer, the term of this patent is extended or adjusted under 35 U.S.C. 154(b) by 113 days.

(21) Appl. No.: 16/956,441

(22) PCT Filed: Jul. 6, 2019

(86) PCT No.: PCT/US2019/040749
§ 371 (c)(1),
(2) Date: Jun. 19, 2020

(87) PCT Pub. No.: WO2020/014091
PCT Pub. Date: Jan. 16, 2020

(65) Prior Publication Data

US 2021/0078677 A1 Mar. 18, 2021

Related U.S. Application Data

(60) Provisional application No. 62/694,987, filed on Jul. 7, 2018.

(51) Int. Cl.
*B63B 32/22* (2020.01)
*B63B 83/00* (2020.01)
(Continued)

(52) U.S. Cl.
CPC ..... *B63B 32/22* (2020.02); *A63B 69/0093* (2013.01); *B63B 21/04* (2013.01); *B63B 32/77* (2020.02); *B63B 83/00* (2020.01); *A63B 2208/0257* (2013.01); *A63B 2209/00* (2013.01); *A63B 2209/08* (2013.01); *A63B 2210/50* (2013.01); *A63B 2225/05* (2013.01); *A63B 2225/09* (2013.01); *A63B 2225/605* (2013.01)

(58) Field of Classification Search
CPC ..... B63B 32/00; B63B 32/20; B63B 32/22; B63B 32/77; B63B 83/00; B63B 21/04; B63B 32/32; A63B 69/0093; A63B 2208/0257; A63B 2209/00; A63B 2209/08; A63B 2210/50; A63B 2225/05; A63B 2225/09; A63B 2225/605
USPC ..... 441/65, 74, 79
See application file for complete search history.

(56) References Cited

U.S. PATENT DOCUMENTS 3,724,012 A 4/1973 Sanderson
4,599,073 A 7/1986 Fryer et al.
(Continued)

*Primary Examiner* — Daniel V Venne
(74) *Attorney, Agent, or Firm* — Hoglund & Pamias, PSC; Roberto J. Rios

(57) ABSTRACT

The invention provides a solution to people who want to enjoy therapeutic exercises in water using body boards but do not yet have the necessary skills to maneuver themselves alone. This invention serves as a way of acquiring these skills through a body board anchored to a fixed position and leaving a reasonable amount of space for the user to freely move his/her body without interfering with the operation of the board.

31 Claims, 23 Drawing Sheets

(51) Int. Cl.

| | |
|---|---|
| ***B63B 32/77*** | (2020.01) |
| ***A63B 69/00*** | (2006.01) |
| ***B63B 21/04*** | (2006.01) |

(56) References Cited

U.S. PATENT DOCUMENTS

| | | | | |
|---|---|---|---|---|
| 4,768,774 | A | 9/1988 | Beasley | |
| 5,069,406 | A * | 12/1991 | Colyer | B63B 32/83 441/74 |
| 5,236,404 | A | 8/1993 | Maclennan | |
| 5,846,167 | A | 12/1998 | Liu et al. | |
| 6,176,815 | B1 | 1/2001 | Riera | |
| 6,267,526 | B1 * | 7/2001 | McLaughlin | B60G 7/003 403/150 |
| 2009/0298652 | A1 | 12/2009 | Lessard | |

* cited by examiner

BODY BOARD SYSTEM AND METHOD OF USING THE SAME

FIELD OF THE INVENTION

The present invention is directed to a body board and its structural arrangement. Specifically, the body board of the invention is generally provided for training, exercise, sports and therapeutic purposes.

BACKGROUND OF THE INVENTION

Many physical activities have been used in the past to exercise and condition the body, both in land and water. However, given the advantage of offering a resistance load to strengthen and condition the body, while absorbing shock and cooling the body during exercise, water has been found to be very convenient when it comes to exercising while relaxing, simultaneously.

Also, swimming has been found to be an excellent form of exercise. Bodyboarding, an exercise derived from swimming, is a resistant exercise that has been developed and used in water for conditioning the body. Bodyboarding is a water sport in which a user rides a wave on top of a bodyboard that takes the user towards the shore. Generally, a bodyboard is a relatively small rectangular apparatus made of a material with buoyant properties. Bodyboarding is an activity generally performed for therapeutic, recreational, relaxation and exercise purposes that promote general good health and well-being to the user. It is also possible to use a bodyboard on other water bodies such as a pool or lake.

Due to lack of experience, the user might face a situation in which he/she does not have appropriate control over the bodyboard stability and direction. This becomes a problem when trying to enjoy water activities during the beginning stages.

While there is a need to solve the above-explained problem, there is no apparatus or system that can gradually adapt a body board so that a user can use it according to the conditions of the body of water in which the board is to be used. While there have been previous solutions that provide some adaptation capabilities, they do not provide a user the necessary freedom and flexibility to completely enjoy the activity.

For example, some previous solutions limit the amount of space a user has to freely expand and move his/her body as if performing the real exercise in an open body of water. At some point the user's body may get tangled up with a cord being used to hold a board or the position in which a support system is positioned provides poor or no stability at all.

Various devices have been designed that allow exercising in the water. However, no singular previously known apparatus has been designed for performing bodyboarding activities solving the stability, flexibility problems associated with the activity.

SUMMARY OF THE INVENTION

The exercise device of the present invention is intended to be useful for the primary purpose of providing a single exercise apparatus constructed in a manner that permits performing in water a wide variety of exercises foe a wide variety of purposes such as therapeutic and recreational uses.

A further object of the invention is to provide an exercise apparatus comprising a rigid body structure made up of material with buoyant properties.

One of the main features of the present invention is that the body board comprises an anchoring system that allows anchoring the board to a desire location for allowing an individual to freely use the board in a controlled and secure manner inside a body of water such as: a beach, lake, river, pool or the like. The board includes a pivoting/rotation mechanism that allows the board to move in any direction (vertical/horizontal/diagonal) while being anchored.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Figure 1:
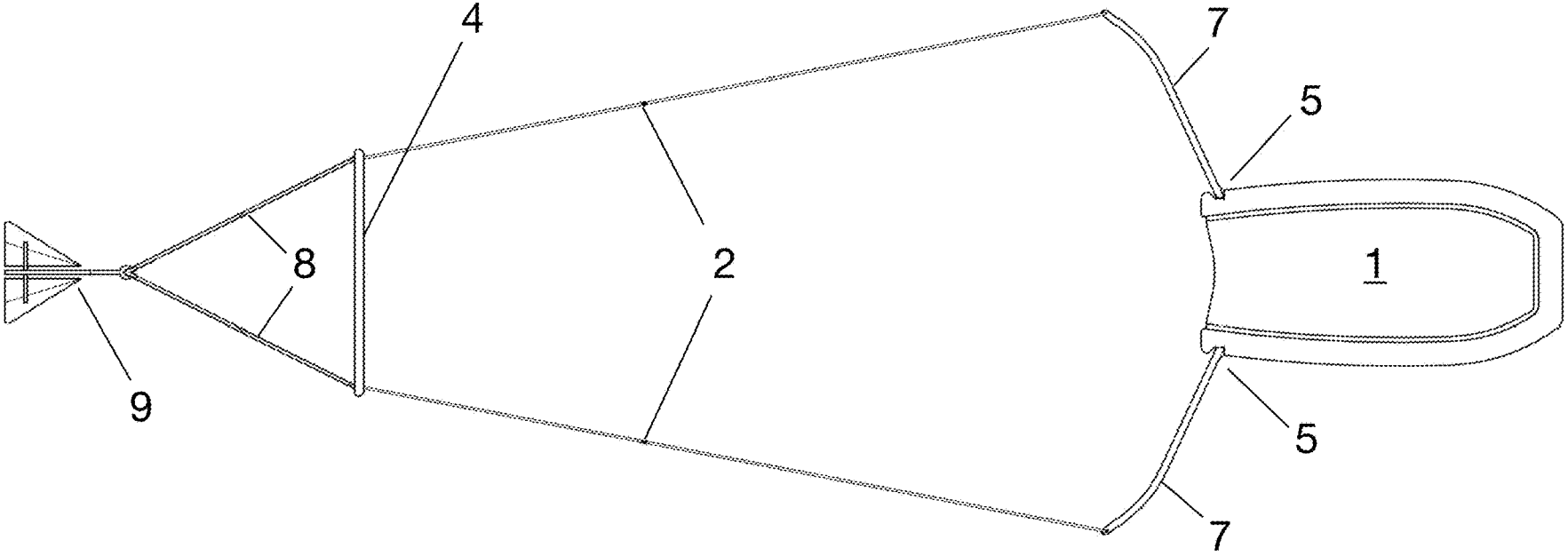
FIG. 1 shows a body board system according to the present invention.
Figure 2A:
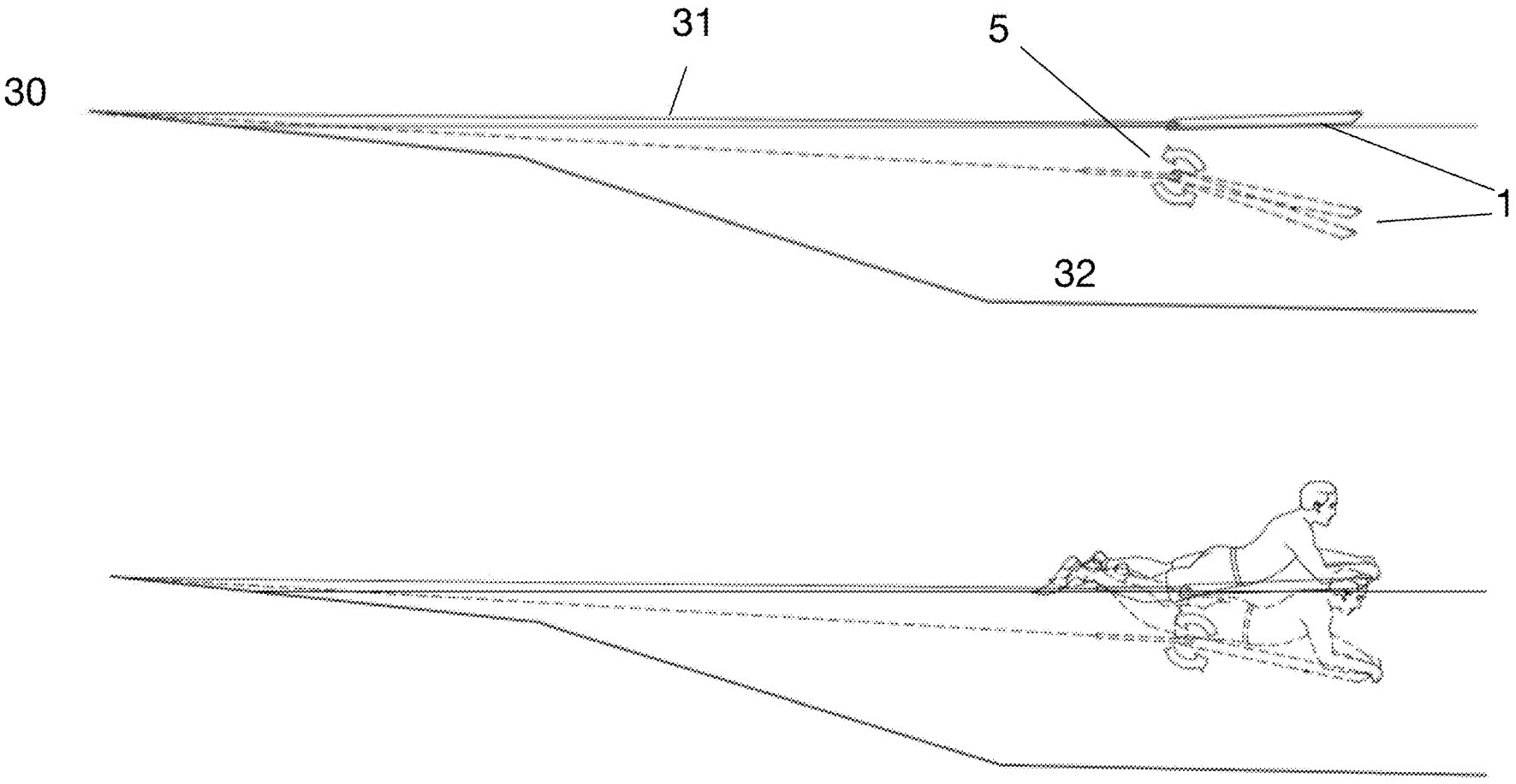
FIG. 2*a* shows the body board system according to an aspect of the present invention.
Figure 2B:
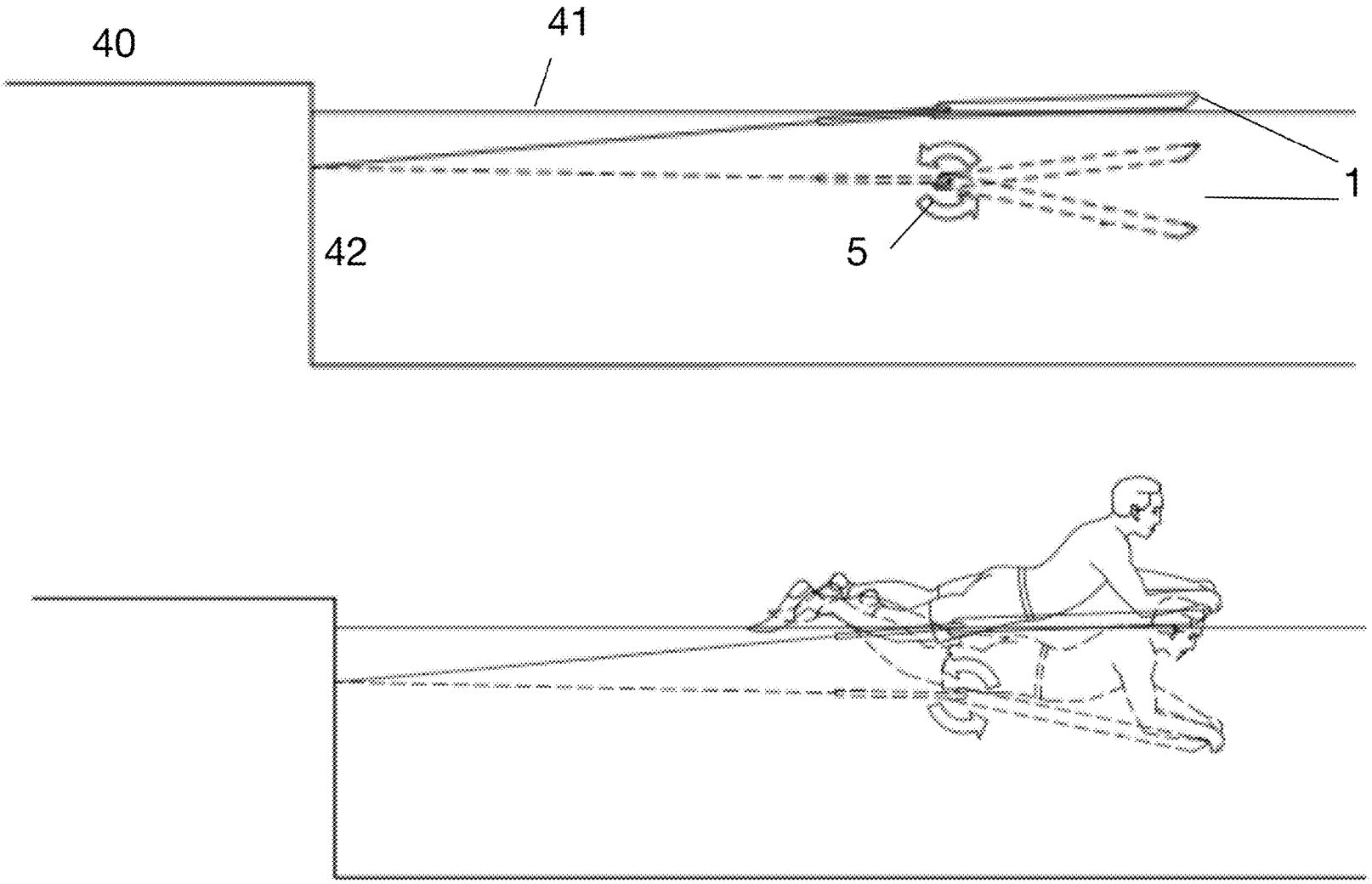
FIG. 2*b* shows the body board system according to another aspect of the present invention.
Figure 2C:
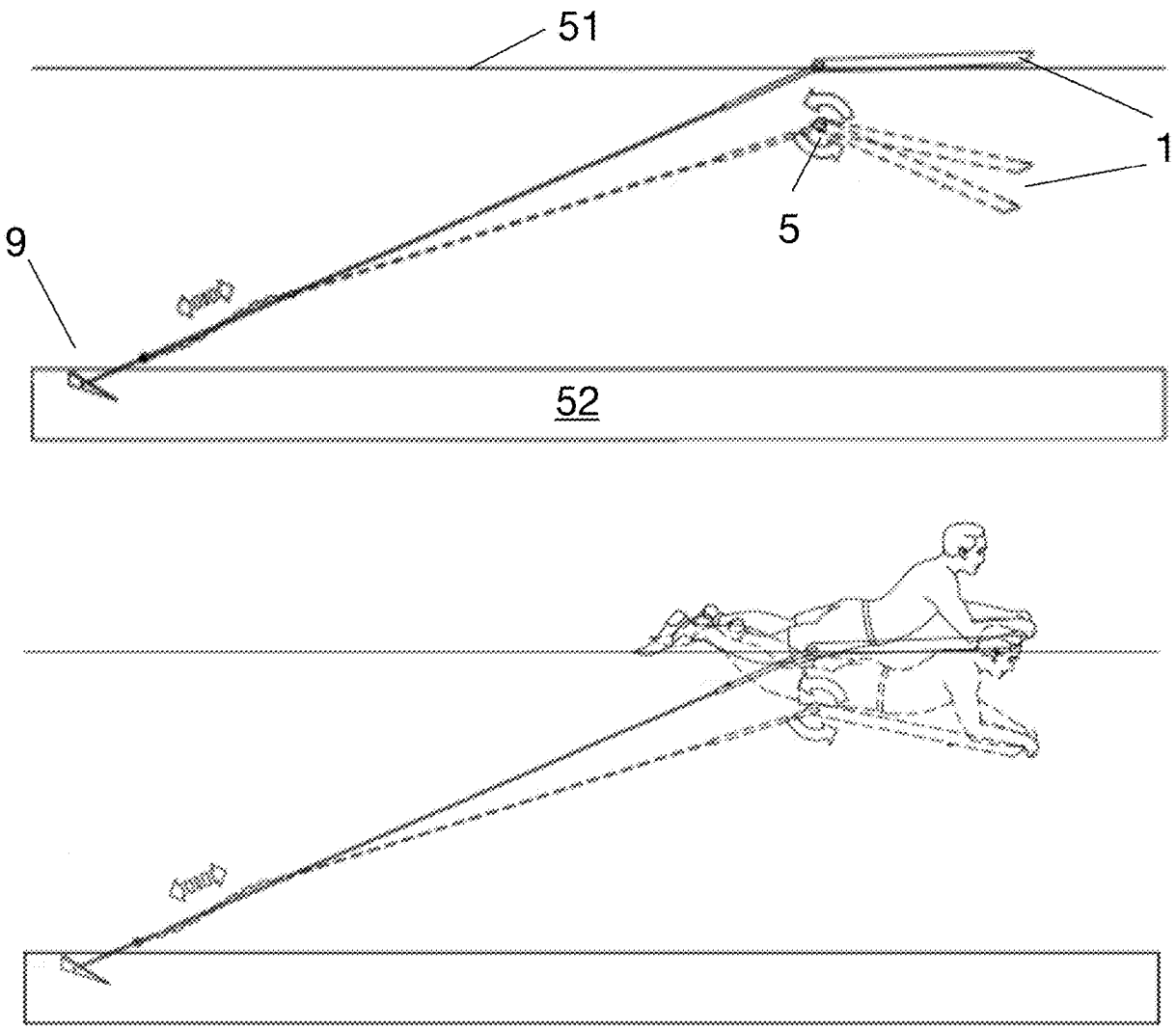
FIG. 2*c* shows the body board system according to still another aspect of the present invention.
Figure 3:
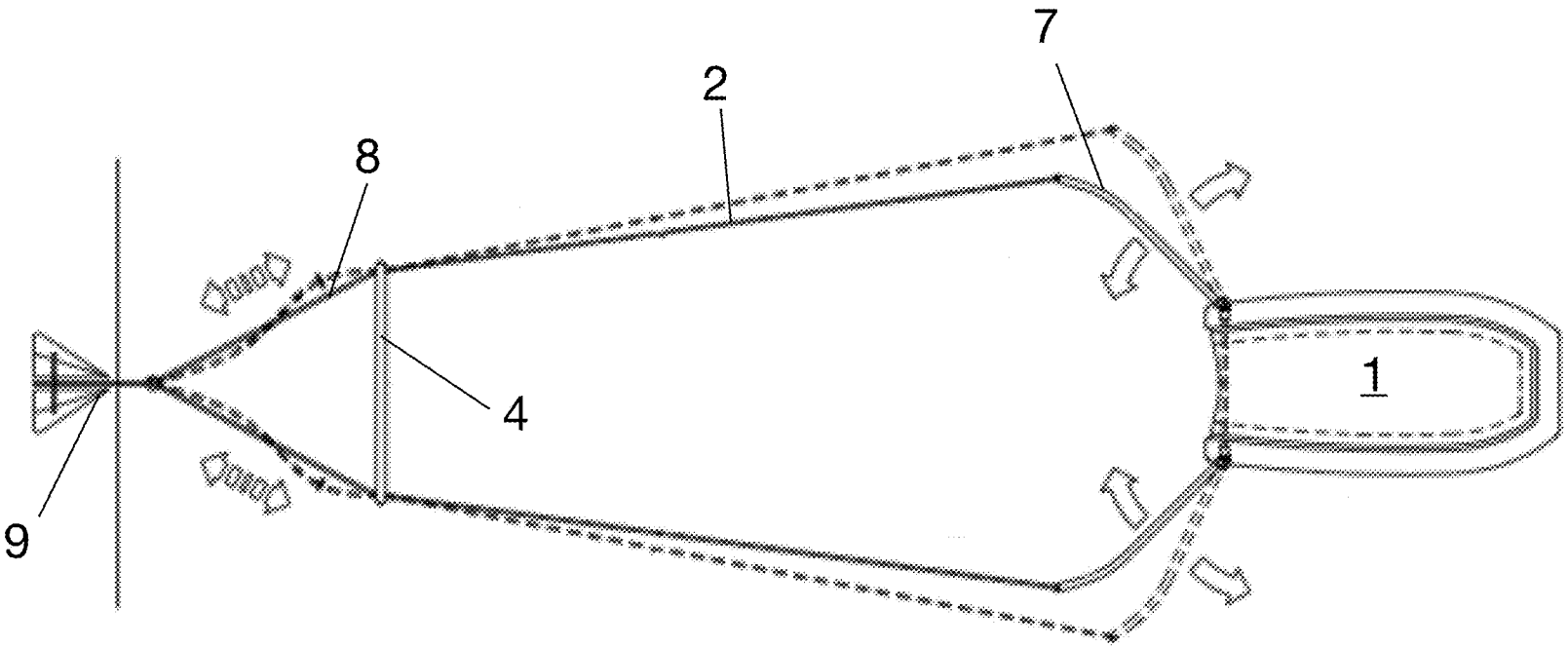
FIG. 3 shows the body board system in extended and rest position according to the present invention.

FIGS. 1-3 show the basic components of the body board system of the invention as well as illustrate the system in operation by a user.

An anchoring system (9) is provided to maintain the board (1) fixed in relation to a static location such as but not limited to a beach shore, a seabed or a wall/ground of a swimming pool. An elastic cord (8) is coupled to the anchoring system (9) for allowing the body board (1) to partially move away from the anchored location in a restricted manner. Once the board (1) moves away a certain distance, whether by a user action or simply by the wave movements, the elastic property of the cord (8) will pull back the board (1) to its initial rest position, as illustrated in FIG. 3. This way, the user is given certain freedom to use the board (1) while providing a controlled environment which is very advantageous when using a board at sea. In a preferred embodiment the system is used on a body board. However, the system of the invention can be implemented and/or used on any floating device (1) having any shape or configuration as long as the device possesses buoyant properties.

The anchoring system (9) can be installed to different locations outside or inside the body of water and below or above the water level (31, 41). For example, the anchoring system (9) can be installed at a sea shore (30) or pool wall (42), a floor of the sea or a pool (52), or any other location that conveniently maintains the body board system of the invention secured to a static location when in use.

Figure 14B:
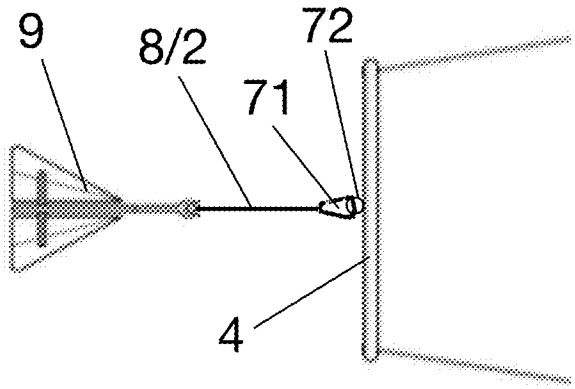
FIGS. 14*a*-14*b* illustrate various anchoring system arrangements according to an aspect of the present invention.
Figure 14A:
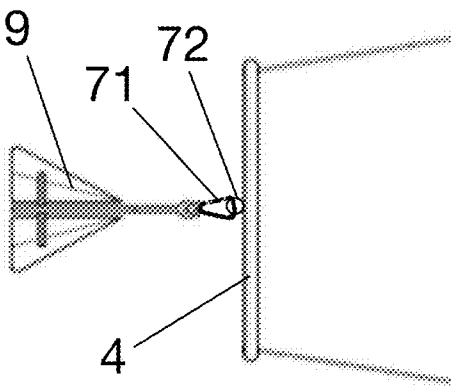

As can be appreciated from the Figures, a spacing bar (4) is further provided for maintaining a specific separation distance between both cords (2) and between both elastic cords (8) so that the body of a person using the board (1) does not interfere or come in contact with cords (2) and elastic cords (8) while using the body board system of the present invention. While the Figures show a pair of elastic cords (8) coupled to the ends of the spacing bar (4), it is also envisioned that a single elastic cord (8) can be coupled preferable to the middle of the spacing bar (4) as long as the same elastic effect is achieved. In addition, the elastic cord or cords (8) can be removably coupled to either or both the anchoring system (9) and the spacing bar (4) by means of a shackle or carabiner that allows the anchoring system (9) and/or the elastic cord or cords (8) to be easily removed and recoupled to the board system, as shown in FIG. 14*b*. Alternatively, the anchoring system (9) can be directly coupled to the spacing bar (4) without the use of the elastic cord or cords (8) as shown in FIG. 14*a*. This arrangement in conjunction with bars (7) allow a user to freely move within a space defined by said spacing bar (4) and bars (7). According to an embodiment of the invention, spacing bar (4) can be a single piece element provided in different lengths so that it can be removed and reinstalled to the system in order to accommodate various separation distances. Alternatively, spacing bar (4) can be an adjustable element selectively adjusted to different separation distances. This can be achieved for example by providing a telescopic bar or a plurality of small elements that can be selectively interconnected to obtain a desired separation distance. Of course, it is to be understood that any equivalent means can be used as long as the separation distance provided by the spacing bar (4) is achieved.

A pair of cords (2) are coupled to the elastic cords (8) at one end and to the bars (7) at the other end, as can be appreciated in FIG. 1. The length of these cords (2) are selected according at least one of: the height of a user and a desired distance between the body board (1) and the anchoring system (9) so that a user can move freely without interruption while using the system. The cords (2) can be preinstalled on the system or alternatively, can be removably exchanged to accommodate various lengths. It is also envisioned that the cords (2) and the elastic cords (8) are directly coupled to the spacing bar (4) at their respective ends instead of being directly coupled between them. This arrangement provides a modular feature that allows each cord (2) and each elastic cord (8) to be individually removed and installed for ease of storage and/or replacement in case of a faulty or broken component.

Figure 13:
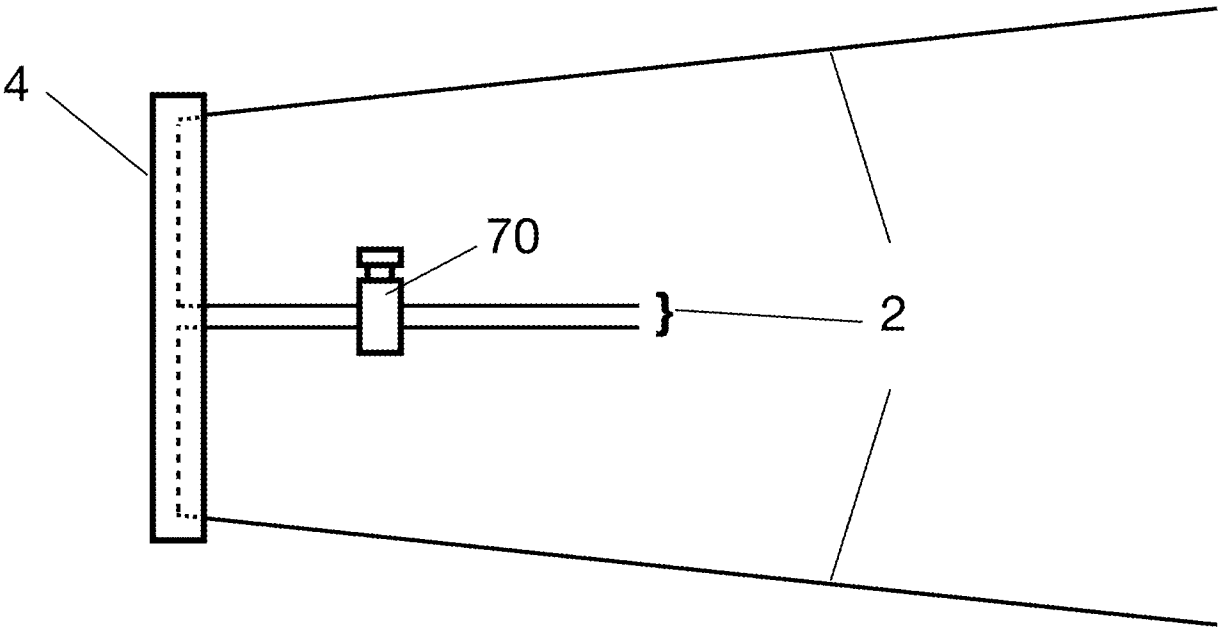
FIG. 13 illustrates a cord-adjusting arrangement according to an aspect of the present invention.

FIG. 13 shows an embodiment where the length of the cords (2) is selectively adjusted in situ using for example: a cord lock, cord fastener, cord stopper or a cord toggle or any equivalent thereof. The ends of cords (2) are inserted inside the spacing bar (4) at its respective ends, which in this embodiment is a hollow bar or have interior hollow passages, and extended towards the middle of the spacing bar (4) where the ends exit into a cord lock (70). As can be appreciated, the length of cords (2) is adjusted by pulling the cords (2) until a desired length is achieved and the lock is actuated. In a preferred embodiment, a dual-slot cord lock is used where each cord (2) is individually inserted into each slot. However, a single-slot lock can be used where both cords (2) are inserted into the single slot.

Figure 15B:
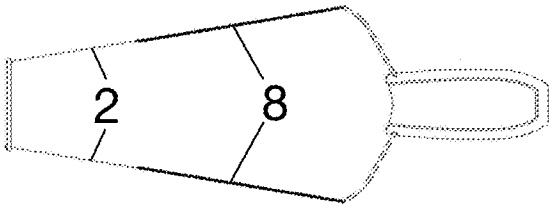
FIGS. 15*a*-15*c* illustrate various elastic cord arrangements according to an aspect of the present invention.
Figure 15A:
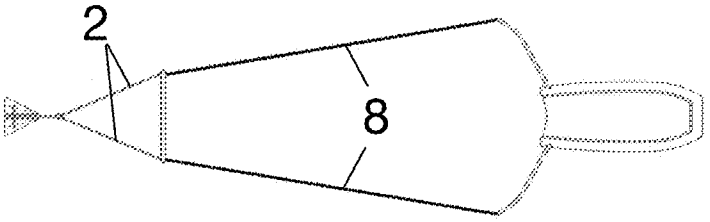
Figure 15C:
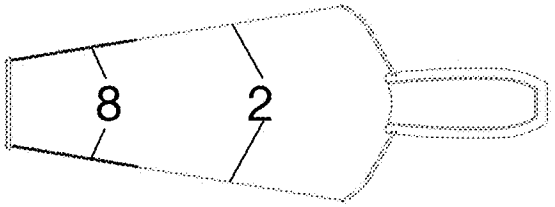

According to an important feature of the invention, the arrangement of elastic cords (8) and cords (2) is alternated and/or eliminated. In an embodiment, the elastic cord (8) can be eliminated so that the anchoring system (9) is directly coupled to the spacing bar (4), as shown in FIG. 14*a*. This can be done for example via a cord/rope, clip or carabiner (71) releasably engaged around the spacing bar (4) or to a ring (72) provided at said spacing bar (4). It is also envisioned that a single elastic cord (8) or cord (2) can be used to couple the anchoring system (9) to the spacing bar (4) as shown in FIG. 14*b*. In another embodiment, the position of the elastic cord(s) (8) and the cords (2) can be interchanged so that the anchoring system (9) is coupled to the spacing bar (4) via cord(s) (2) and the spacing bar (4) is coupled to the bars (7) via elastic cords (8) as shown in FIG. 15*a*. In addition, the cords (2) that connect the spacing bar (4) to the bars (7) can be replaced by a hybrid cord comprising a portion made of elastic cord (8) and another portion made of cord (2) as shown in FIGS. 15*b*-15*c*.

A pair of solid bars (7) is specifically provided to extend substantially perpendicular from the sides of the board (1), as shown in the Figures. In the context of this invention, "substantially perpendicular" means that the solid bar extends sideways away from the sides of the board (1) in a generally perpendicular direction, wherein the solid bar can have some degree of curvature or bending. The length of theses solid bars (7) can be selected based on the body size and body type (slim, obese, etc.) of a user to provide sufficient room or space to the sides of a user body while using the system. In addition, cords (2) can be fixed or removably coupled to the solid bars (7). As will be explained below, a pivoting/rotation system (5) is provided on the sides of the board (1) and works in conjunction with the solid bars (7) to delimit a specific zone or area where the board (1) can move freely with no interference or contact between the person and the system. According to the invention, the pivoting/rotation system (5) allows the board (1) to move in any direction, including upwards and downwards (FIGS. 2*a*-2*c*, FIG. 4*b*), sideways (FIG. 3 and FIG. 4*c*) and even diagonally.

The body board (1) is a floating object that allows the user to adopt or acquire different postures and movements according to the exercise, training or therapeutic activity to be performed. It is also envisioned that a user can wear swim fins (10) while using the body board (1) of the invention. Generally, a person would wear swim fins on his/her feet to create different levels of resistance between the body of water and the board (1) when a force is exerted by the user while moving his/her feet.

Figure 4A:
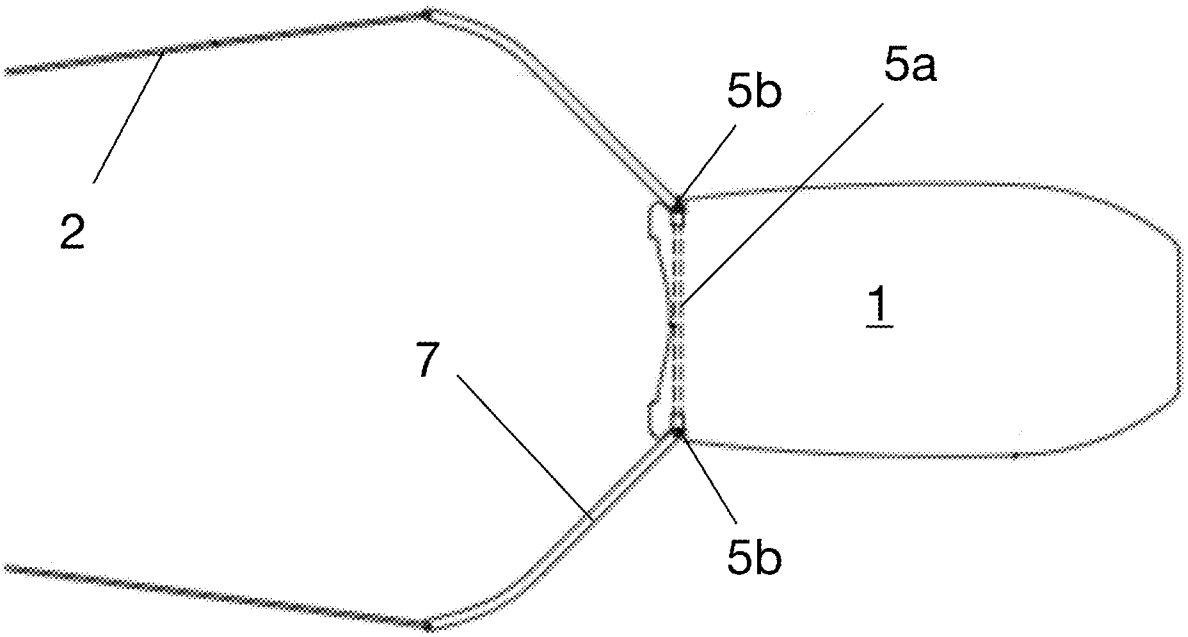
FIGS. 4*a*-4*c* shows the body board system according to an aspect of the present invention.
Figure 4B:
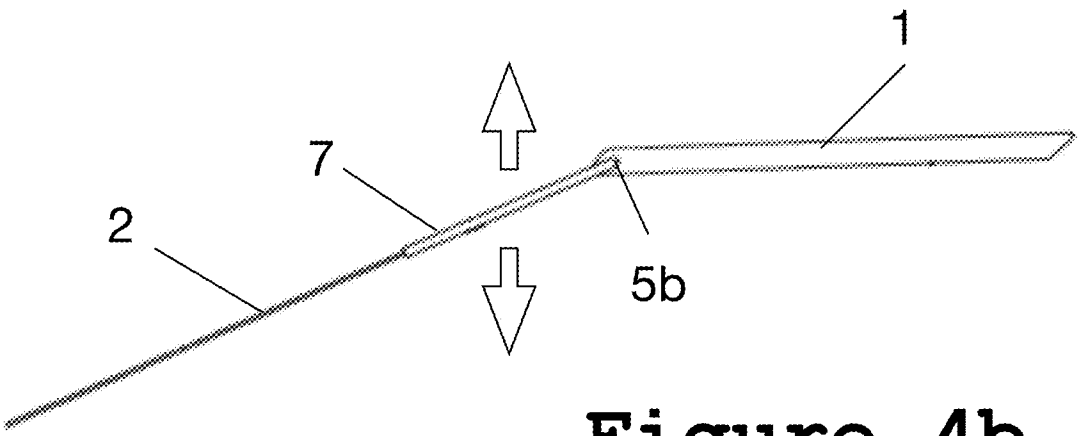
Figure 4C:
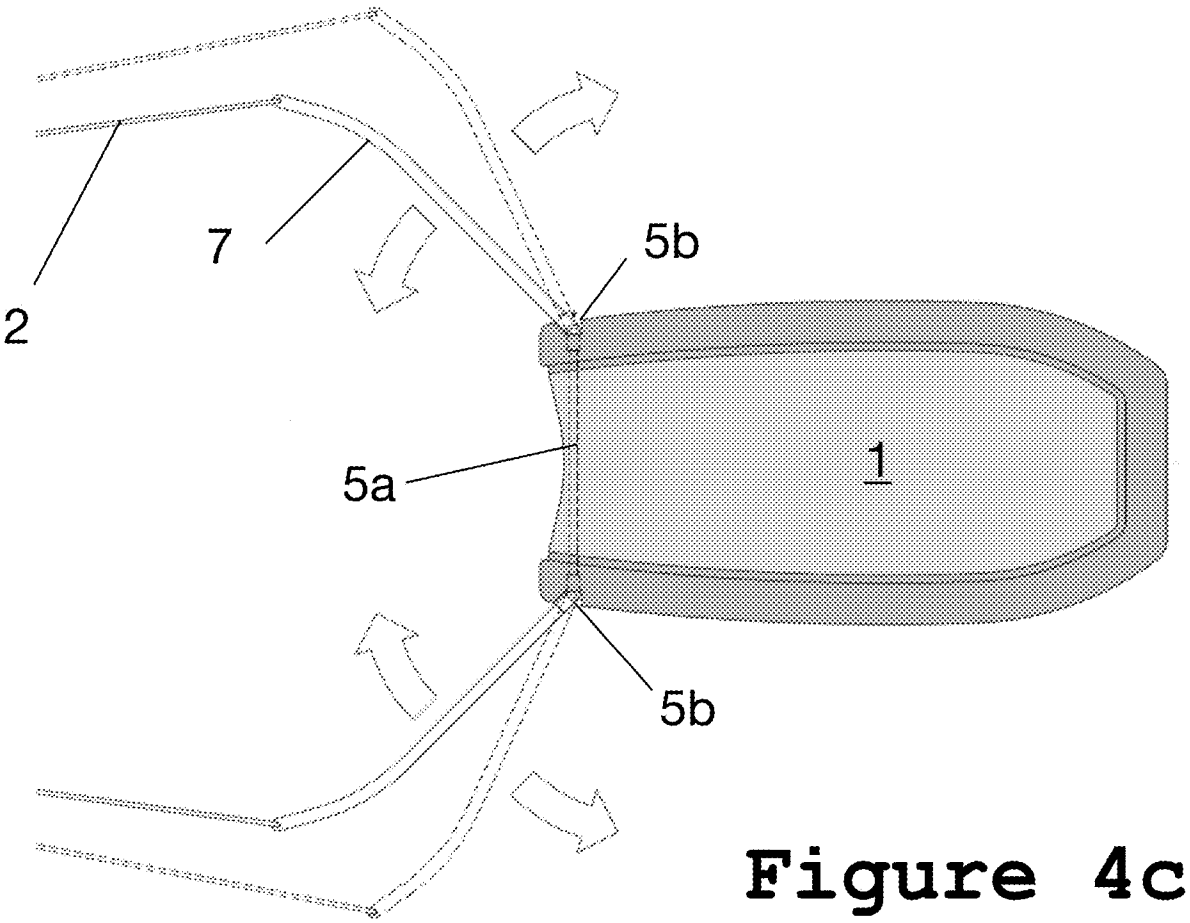

FIGS. 4*a*-4*c* illustrate a preferred embodiment of the board system according to the present invention. Specifically, the solid bars (7) and the pivoting/rotation system (5) are coupled to the board (1) be means of a passing bar (5*a*) positioned inside a passthrough channel passing through a bottom end of the board (1) from one side to the other side of the board (1). Pivot/rotation elements (5*b*) are provided to allow each solid bar (7) to move sideways independently. At the same time, both solid bars (7) move upwards and/or downwards simultaneously due the passing bar (5*a*) which is coupled on its ends to the solid bars (7) and the pivoting/rotation elements (5*b*), wherein the passing bar (5*a*) rotates freely inside the passthrough channel.

Figure 4D:
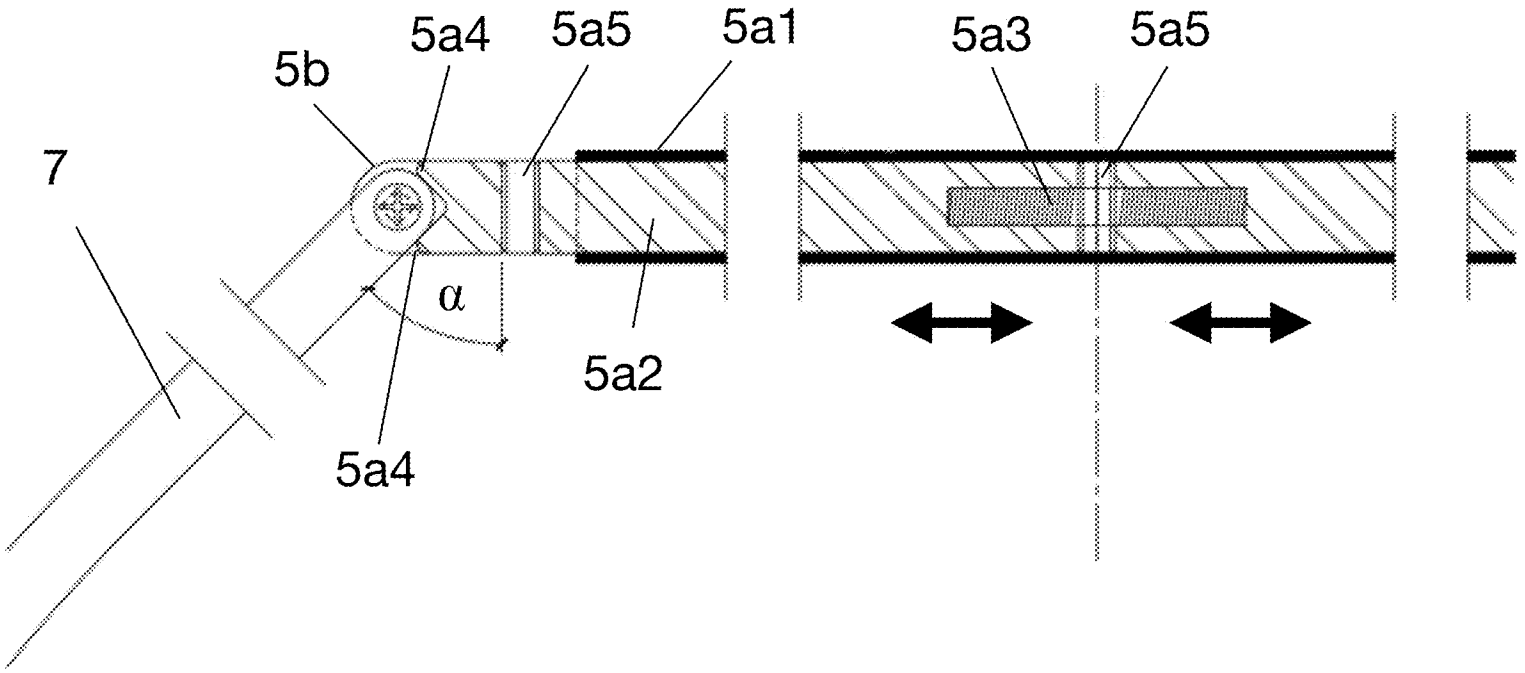
FIG. 4*d* illustrates an interconnection arrangement between the passing bar, the pivot/rotation element and the solid bar according to an aspect of the present invention.

FIG. 4*d* shows an embodiment of the interconnection between the passing bar (5*a*), the pivot/rotation element (5*b*) and the solid bar (7) according to the present invention. Specifically, pivot/rotation element (5*b*) couples the solid bar (7) to an end of the passing bar (5*a*). In this embodiment the pivot/rotation element (5*b*) is implemented by a screw or a pin inserted and secured into a hole provided on the end of the passing bar (5*a*). This arrangement allows the solid bar (7) to pivot/rotate sideways in an angular limited range $\alpha$. The rotational sideways movement is limited by detents (5*a*4) provided on the end of the passing bar (5*a*4) as shown in the Figure. A solid bar (5*a*2) is positioned inside a tube (5*a*1), which in turn is positioned inside the passthrough channel. Solid bar (5*a*2) can be single piece element or alternatively, can be a plurality of elements removably coupled between them for example by means of a screw/thread arrangement (5*a*3). In an alternate embodiment, at least one ball joint arrangement (5*a*5) is provided for allowing the solid bar (7) to rotate upward and downward in relation to the board (1). It is also possible that the solid bar (5*a*2) and tube (5*a*1) remain static inside the passthrough channel while the ball joint arrangement (5*a*5) provides the rotation movement to the solid bar (7) or the solid bar (5*a*2) and tube (5*a*1) arrangement can also rotate independently of said ball joint arrangement (5*a*5) providing a higher degree of flexibility and control of the system. It is also envisioned that the ball joint arrangement (5*a*5) can be replaced or even integrated into a screw/thread arrangement that allows to couple/uncouple the solid bar (7) from the solid bar (5*a*2).

Figure 5A:
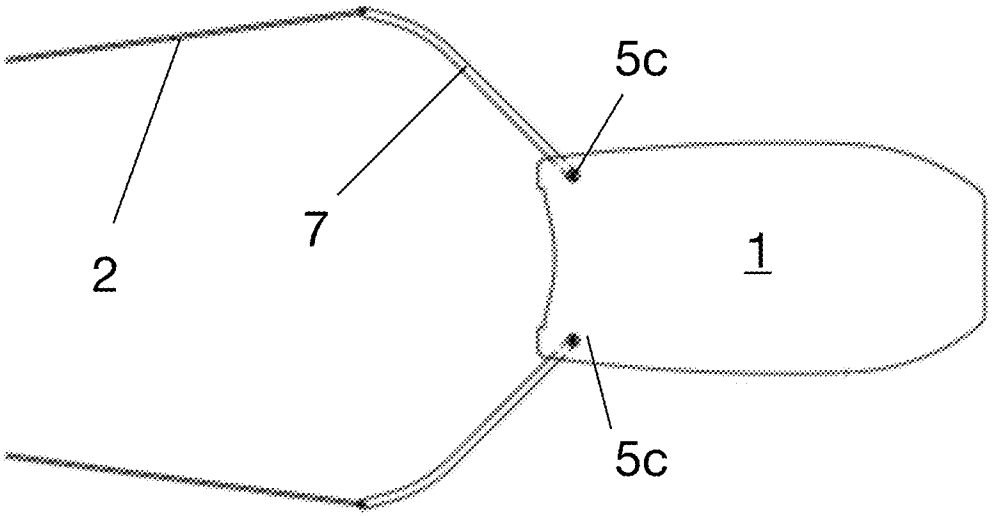
FIGS. 5*a*-5*b* illustrate an interconnection arrangement between the pivot/rotation element and the solid bar according to another aspect of the present invention.
Figure 5B:
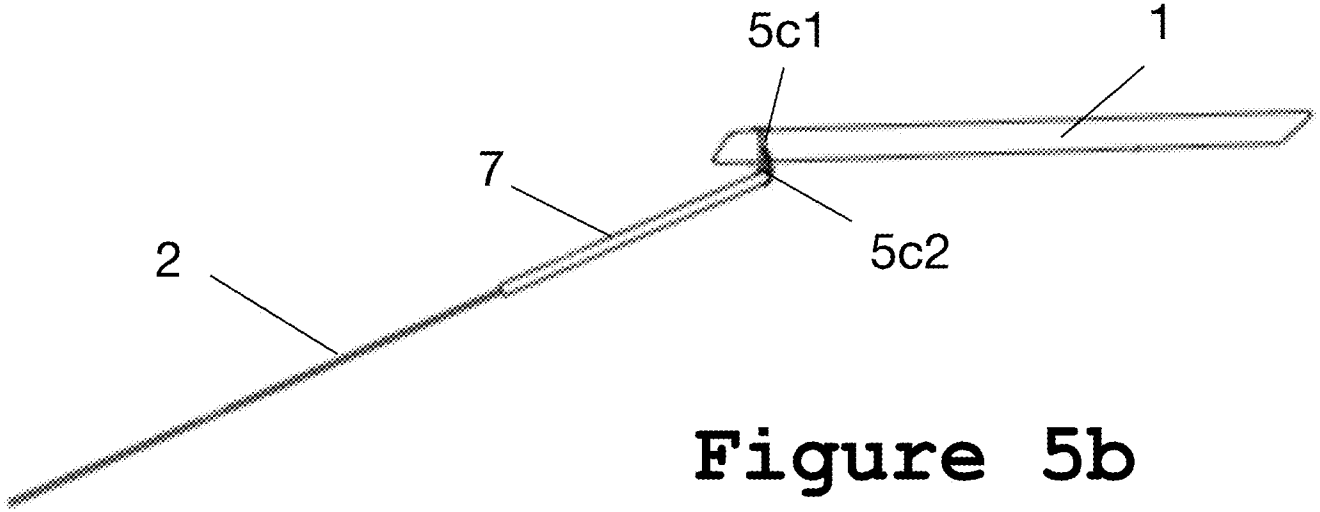

FIG. 5*a* and FIG. 5*b*, illustrate the interconnection between a pivot/rotation element (5*c*) and the solid bar (7) according to an embodiment of the present invention. Specifically, a passthrough element (5*c*1) such as a screw is provided inside a passthrough channel, wherein a bottom end of said passthrough element (5*c*1) protrudes from the passthrough channel below the board (1) and is coupled to the solid bar (7). A pivot/rotation element (5*c*2) is provided so that the solid bar (7) can move freely in any direction in relation to said board (1). Pivot/rotation element (5*c*2) can be implemented for example by a ball/socket arrangement or any other equivalent element that couples the solid bar (7) to the board (1) while allowing free movement of the solid bar (7) in relation to the board (1).

Figure 6A:
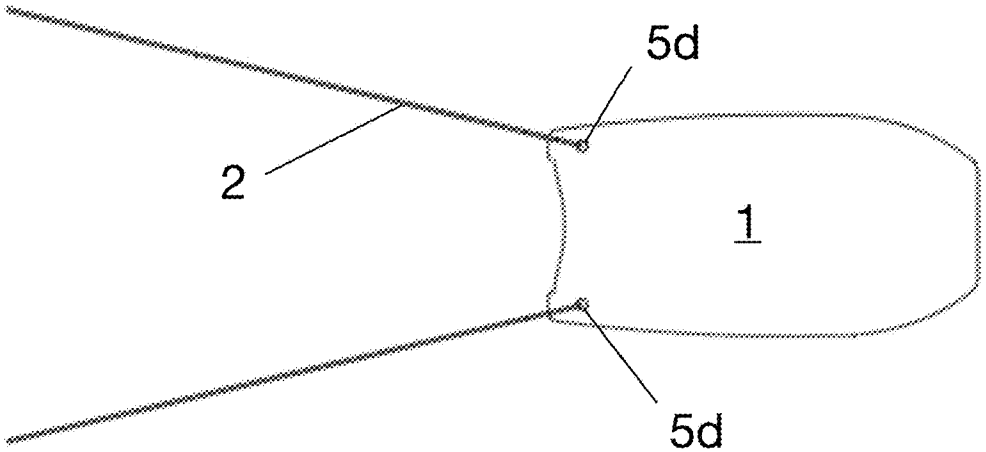
FIGS. 6*a*-6*b* illustrate the interconnection arrangement between the pivot/rotation element and the board according to one aspect of the present invention.
Figure 6B:
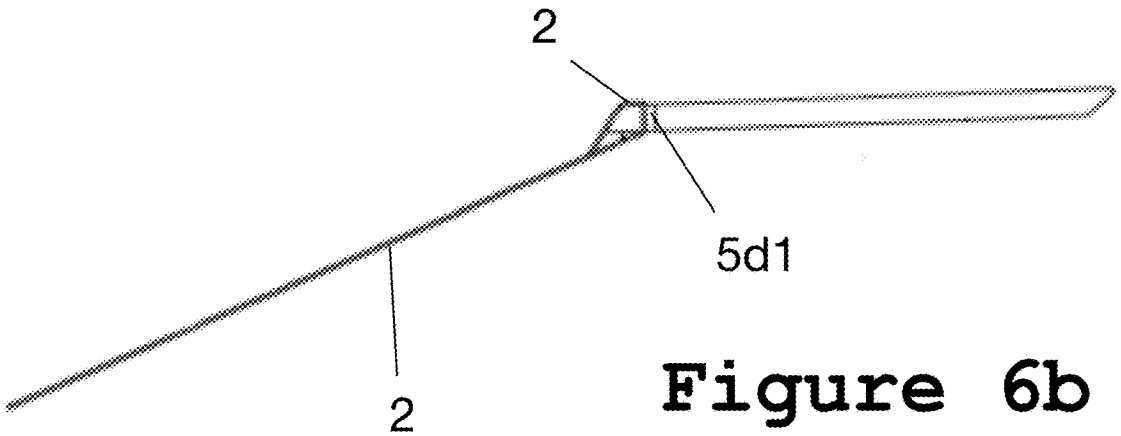

FIG. 6*a* and FIG. 6*b*, illustrate the interconnection between a pivot/rotation element (5*d*) and the board (1) according to another embodiment of the present invention. Specifically, the solid bar (7) is omitted and the cord (2) is directly coupled to a passthrough hole (5*d*1) on the board (1). The cord (2) can be simply tied to the board (1) with a knot or a releasable element such as a carabiner can be provided to selective attach/detach the cord (2) from the passthrough hole (5*d*1).

Figure 7A:
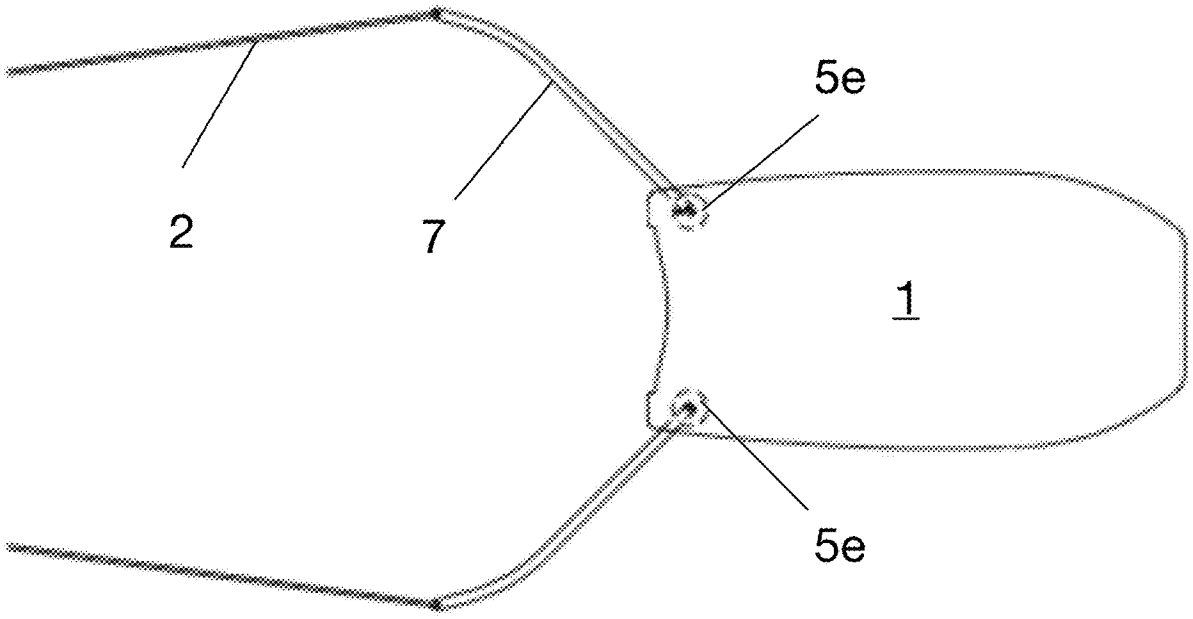
FIGS. 7*a*-7*b* illustrate the interconnection arrangement between the solid bar the pivot/rotation element and the board according to an aspect of the invention.
Figure 7B:
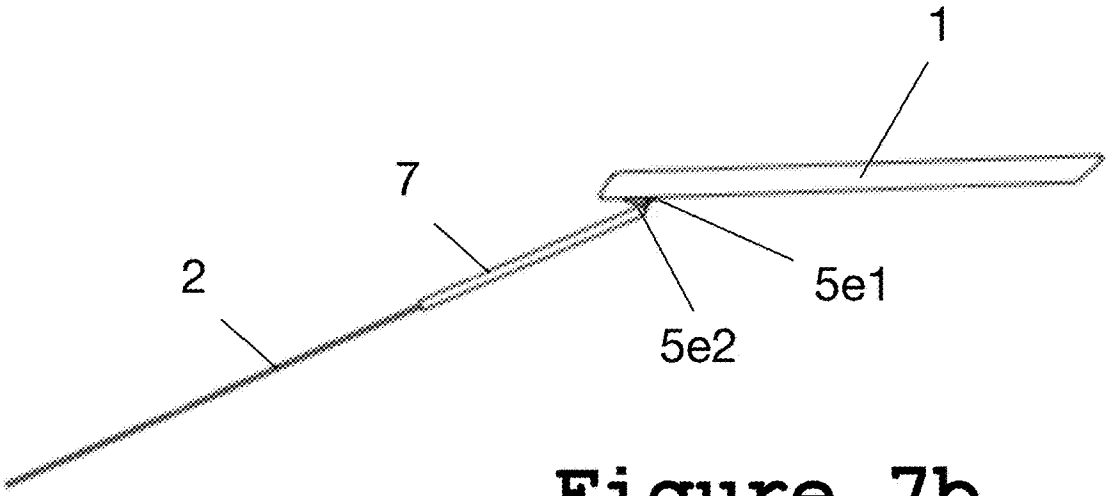

FIG. 7*a* and FIG. 7*b*, illustrate the interconnection between solid bar (7), pivot/rotation element (5*e*) and the board (1) according to an embodiment of the present invention. Specifically, a removable suction element (5*e*1) is removably attached to a side lower portion of the board (1), wherein a pivot/rotation element (5*e*2) couples the solid bar (7) to the removable suction element (5*e*1). As in previous embodiments, pivot/rotation element (5*e*1) can be implemented for example by a ball/socket arrangement or any other equivalent element that couples the solid bar (7) to the board (1) while allowing free movement of the solid bar (7) in relation to the board (1).

Figure 8A:
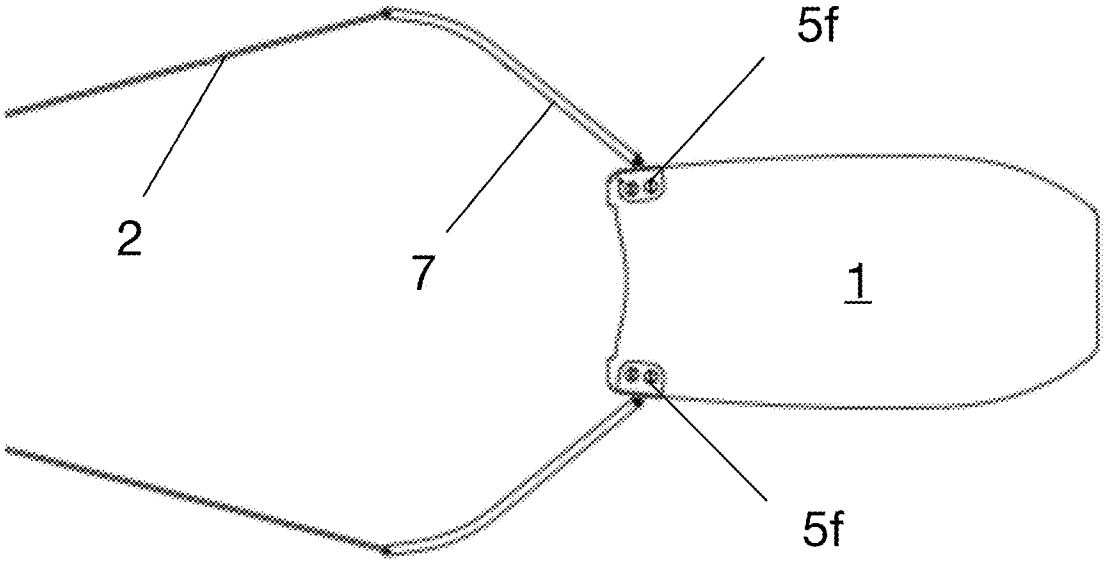
FIGS. 8*a*-8*b* illustrate the interconnection arrangement between the solid bar, the pivot/rotation element and the board according to another aspect of the invention.
Figure 8B:
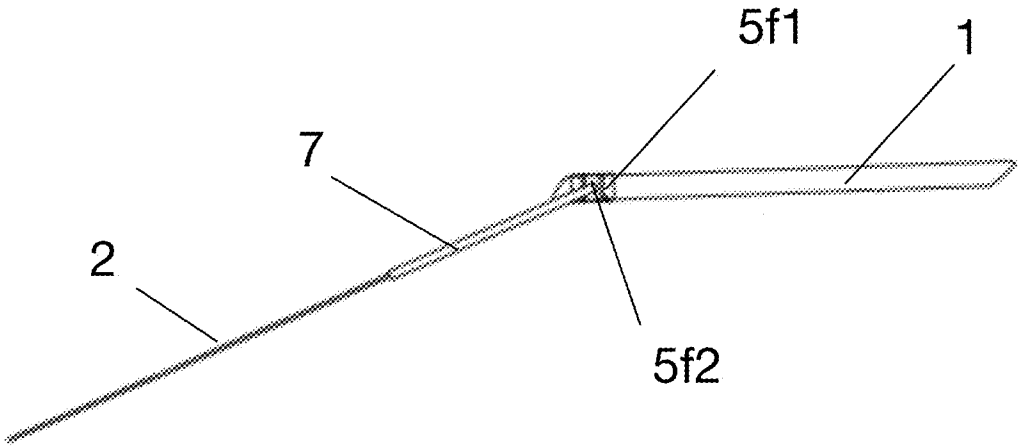

FIG. 8*a* and FIG. 8*b*, illustrate the interconnection between solid bar (7), pivot/rotation element (5*e*) and the board (1) according to an embodiment of the present invention. Specifically, a clamp element (5*f*1) is coupled to the side of the board (1) to exert a grapping force against a top and a bottom portion of the board (1) as shown in the Figures. Preferably, the clamp element (5*f*1) is affixed to the board (1) with screws or any other removable fixing means that presses and secures the clamp element (5*f*1) against the board (1). As shown in FIG. 8*a*, pivot/rotation element (5*f*2) is coupled to the sides of the clamp element (5*f*1) via a ball/socket arrangement, an end of the solid bar (7) being inserted and locked inside an opening on said clamp element (5*f*1), or any equivalent means.

Figure 9A:
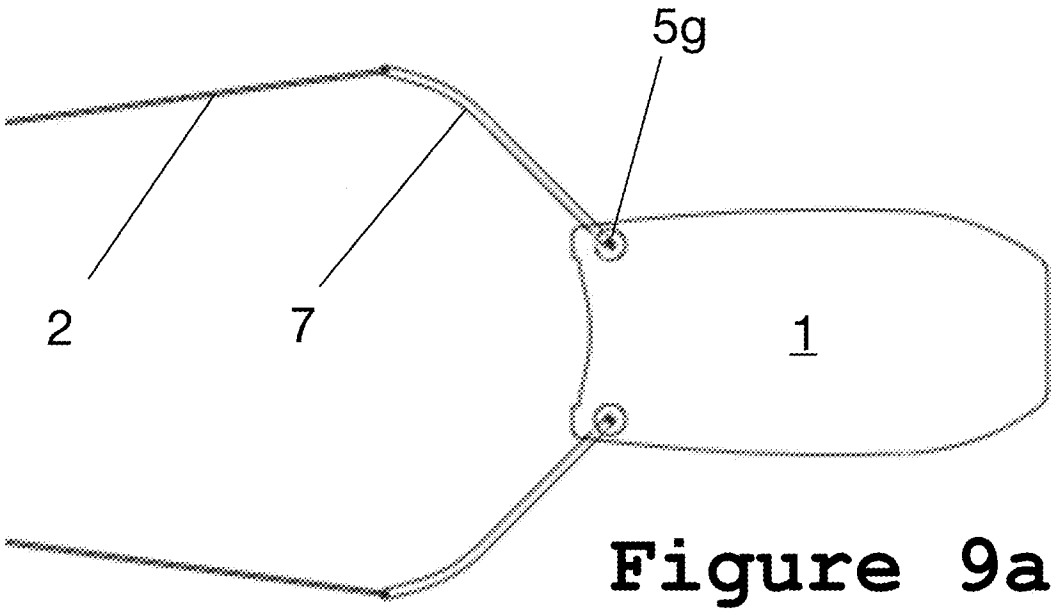
FIGS. 9*a*-9*b* illustrate the interconnection arrangement between the solid bar, the pivot/rotation element and the board according to one aspect of the invention.
Figure 9B:
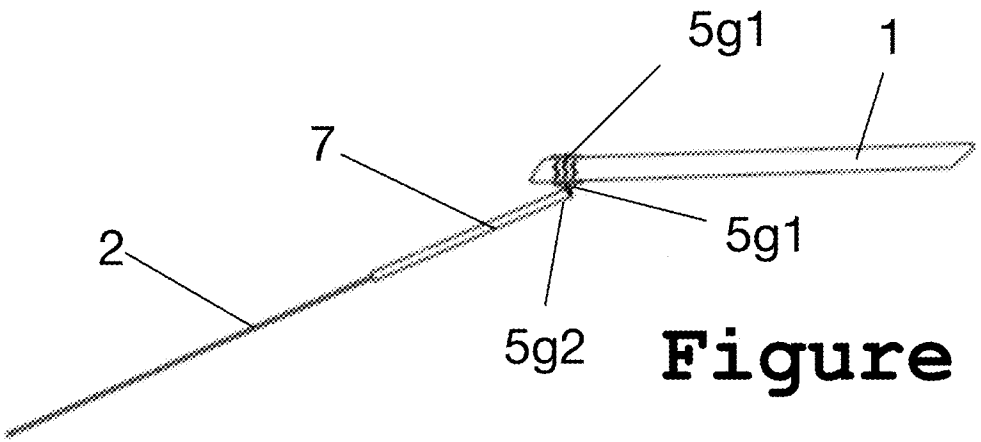

FIG. 9*a* and FIG. 9*b*, illustrate the interconnection between solid bar (7), pivot/rotation element (5*g*) and the board (1) according to another embodiment of the present invention. Specifically, a pair of magnetic elements (5*g*1) are positioned on said board (1) directly over each other as shown in FIG. 9*b*, wherein the pivot/rotation element (5*g*2) to either the top or bottom magnetic element (5*g*1). Any of the previously explained pivoting/rotating means can be used for the pivot/rotation element (5*g*2).

Figure 10A:
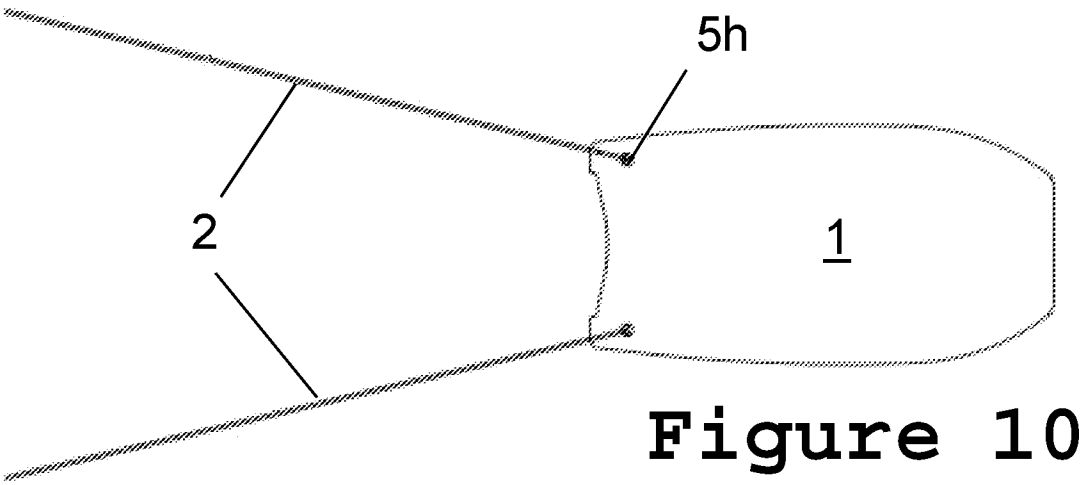
FIGS. 10*a*-10*b* illustrate the interconnection arrangement between cords, the pivot/rotation element and the board according to an aspect of the invention.
Figure 10B:
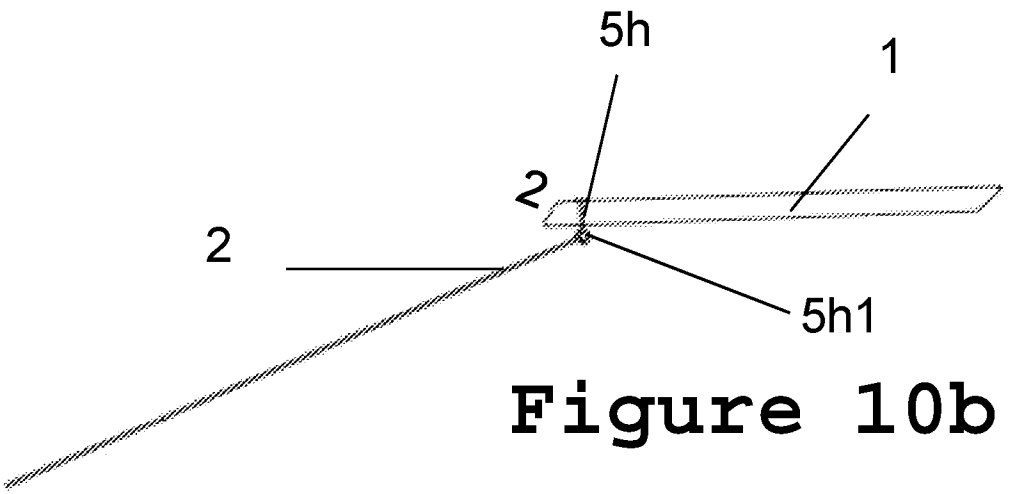

FIG. 10*a* and FIG. 10*b*, illustrate the interconnection between cords (2), pivot/rotation element (5*h*) and the board (1) according to another embodiment of the present invention. Specifically, a passthrough element (5*h*) such as a screw or rod is provided inside a passthrough channel, wherein a bottom end of said passthrough element (5*h*) with a shackle portion (5*h*1) protrudes from the passthrough channel below the board (1) and is coupled to the cord (2). In this case, the solid bar (7) is omitted and the cord (2) is directly coupled to the passthrough element (5*h*). The cord (2) can be simply tied to the shackle portion (5*h*1) with a knot or a releasable element such as a carabiner can be provided to selective attach/detach the cord (2) from the passthrough element (5*h*).

Figure 11A:
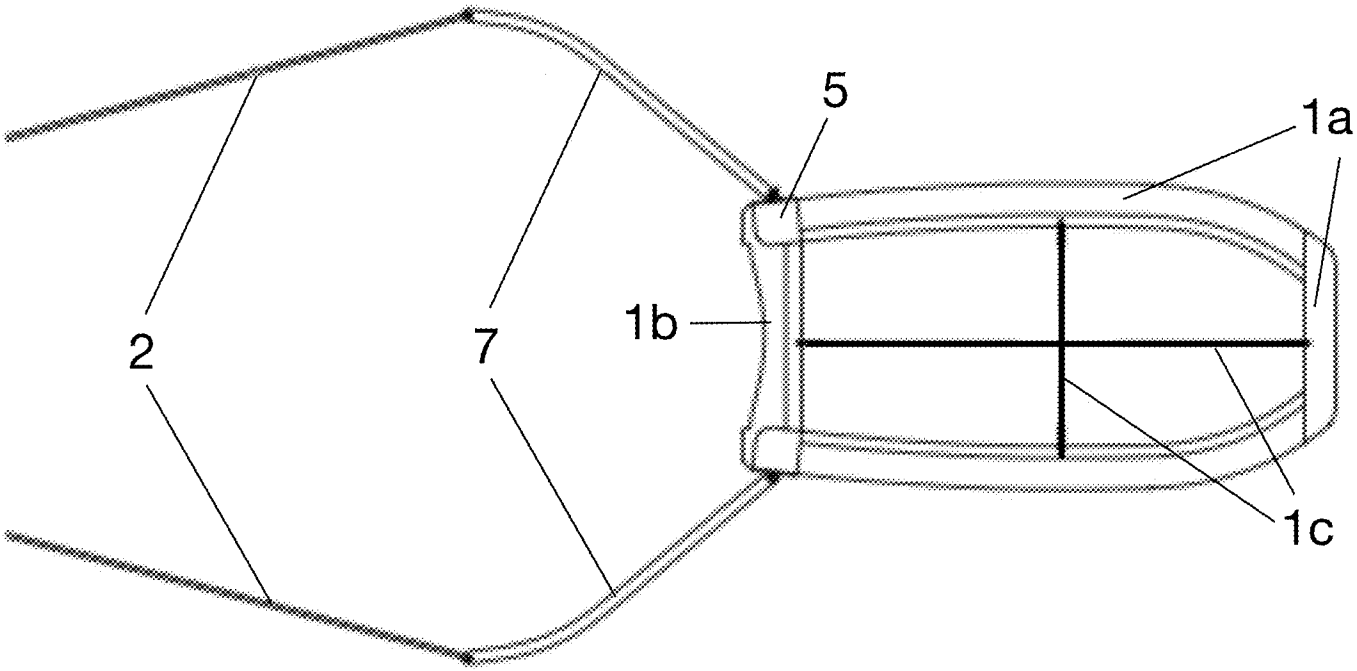
FIG. 11*a* illustrates another embodiment of the body board system according to an aspect of the present invention.

FIG. 11*a* illustrates another embodiment of the body board system according to the present invention. A board (1) is provided as a modular element having a plurality of separate components (1*a*, 1*b*, 1*c*) that are coupled together to form a board (1). As can be appreciated from the Figure, components (1*a*) are assembled together with rear component (1*b*), wherein straps (1*c*) are coupled across and between the components to form a skeleton base. A cover (not shown) is finally placed over the assembled components to provide a board (1). Components (1*a*), (1*b*) and (1*c*) are made of a material with buoyant properties so that the assembled board (1) floats on top of a body of water. Solid bars (7) can be removably coupled from the rear component (1*b*) in order to provide a completely modular body board system. It is envisioned that the solid bar (7) can be a single element bar or a plurality of smaller interconnected bars forming the solid bar (7) when assembled.

Figure 11B:
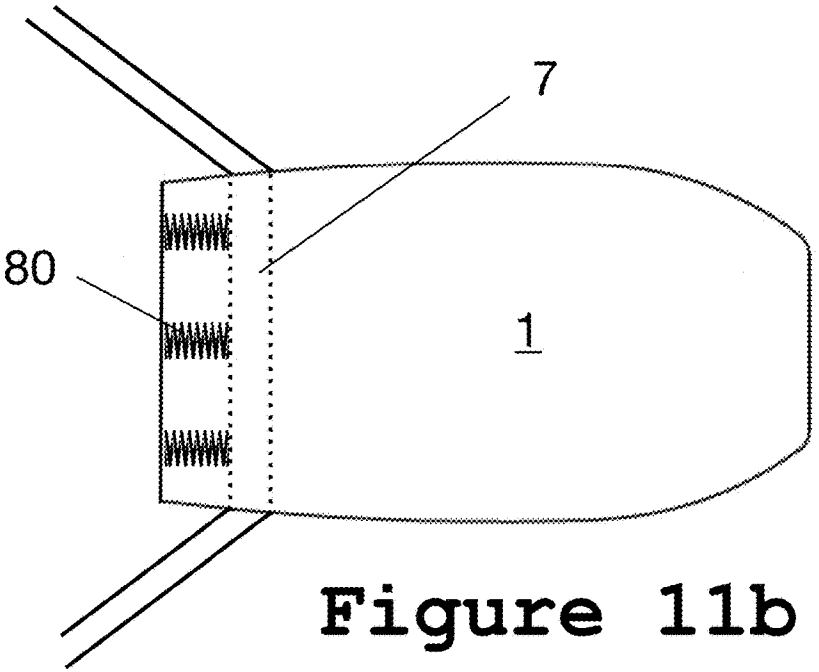
FIGS. 11*b*-11*c* illustrate an elastic spring element arrangement according to an aspect of the invention.
Figure 11C:
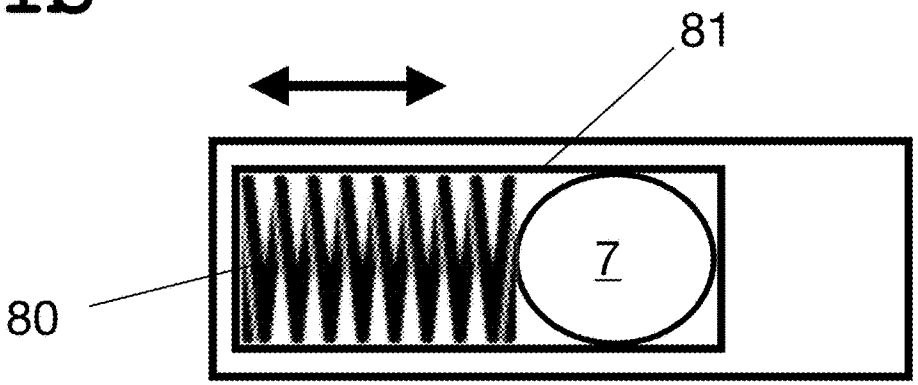

FIG. 11*b* and FIG. 11*c*, illustrate an alternate embodiment of the board system according to the present invention, where the elasticity feature provided by the elastic cord (8) is replaced by a spring/tensioning system (8). In this embodiment, the board (1) is provided with an interior passage (81) where at least one spring element (80) is positioned against the solid bar (7) as shown in FIG. 11*b*. In operation, the spring element (80) has the necessary length to ensure that the solid bar (7) remains relatively at the same horizontal position within the interior passage (81) while in use. Since the board (1) will be anchored to a static location, a pulling force will be exerted unto the solid bar (7) once the cord (2) is completely extended as illustrated in FIG. 1. At that point, the spring element (80) will be compressed by the solid bar (7) providing a smooth resistance against the pulling force equivalent to the resistance provided by the elastic cord (8). Once the pulling resistance is removed, the spring element (80) will return back to its original position pushing the solid bar (7) also towards its original position.

Figure 11D:
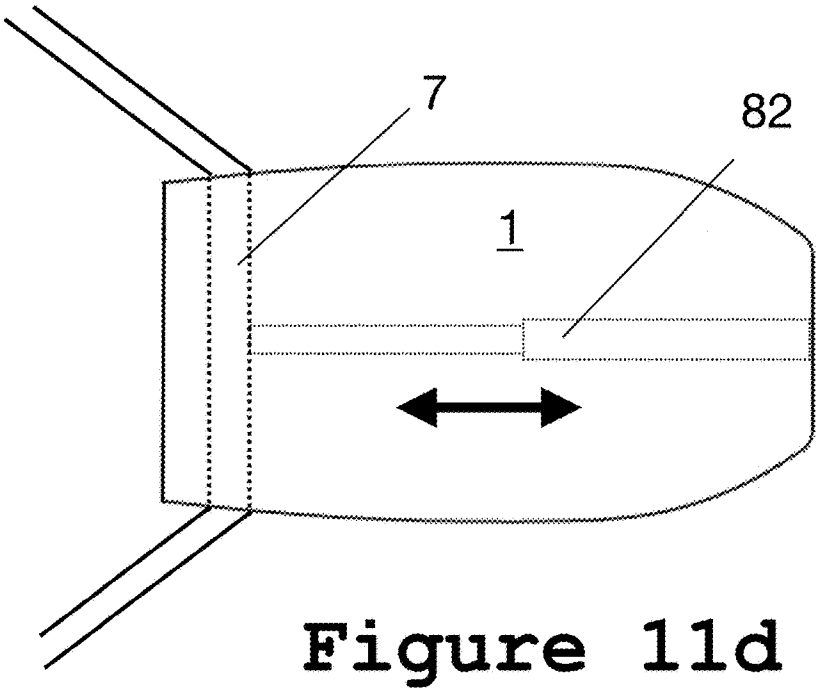
FIGS. 11*d*-11*e* illustrate an elastic shock absorber/damper arrangement according to an aspect of the invention.
Figure 11E:
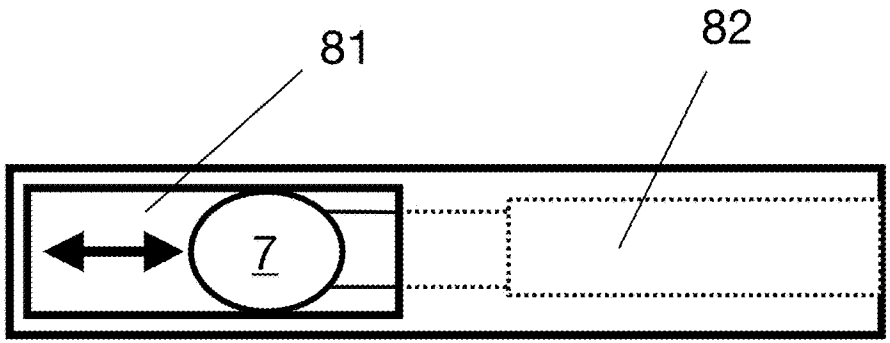

FIG. 11*d* and FIG. 11*e*, illustrate another embodiment of the board system according to the present invention, where the elasticity feature provided by the elastic cord (8) is replaced by a shock absorber/damper (82). As can be appreciated, the board (1) is provided with an interior passage (81) where the solid bar (7) is positioned and coupled to an end of the shock absorber/damper (82) which is longitudinally positioned along the length of the board (1) as shown in the Figures. In operation, the shock absorber/damper (82) holds the solid bar (7) relatively at the same horizontal position within the interior passage (81) while in use. Since the board (1) will be anchored to a static location, a pulling force will be exerted unto the solid bar (7) once the cord (2) is completely extended as illustrated in FIG. 1. At that point, the shock absorber/damper (82) will be pulled by the solid bar (7) providing a smooth damping and impact absorbing resistance against the pulling force equivalent to the resistance provided by the elastic cord (8). Once the pulling resistance is removed, the shock absorber/damper (82) will return back to its original position pulling the solid bar (7) also towards its original position. It is envisioned, that more than one shock absorber/damper (82) can be used.

Figure 11G:
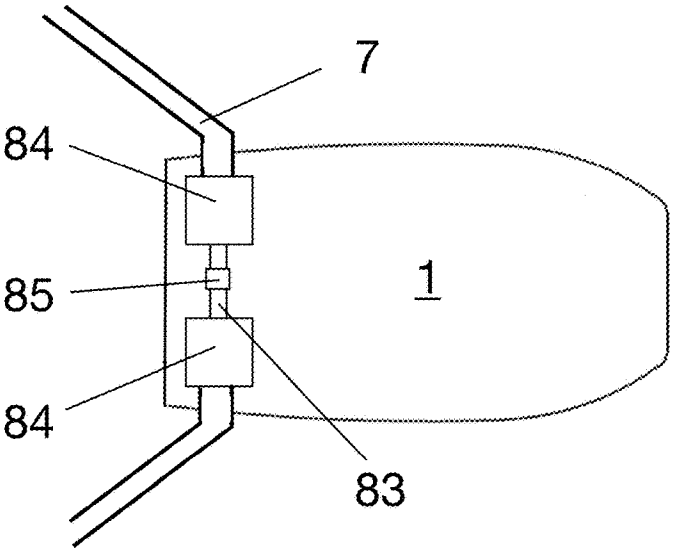
FIGS. 11*f*-11*k* illustrate a retrofit kit arrangement according to an aspect of the invention.
Figure 11F:
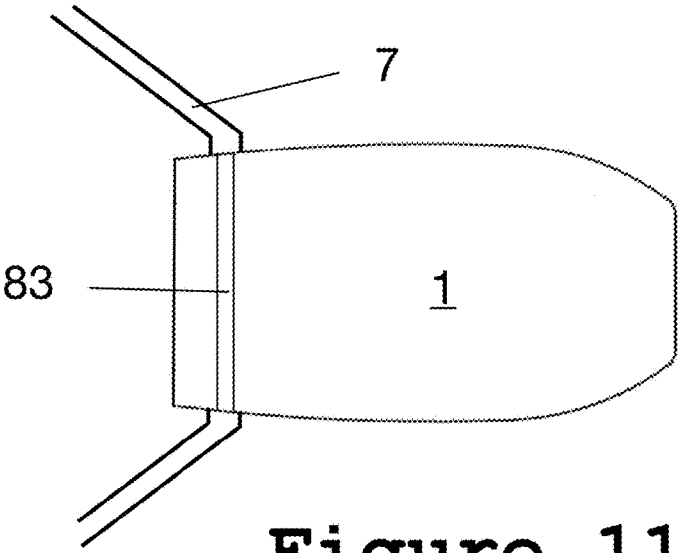
Figure 11H:
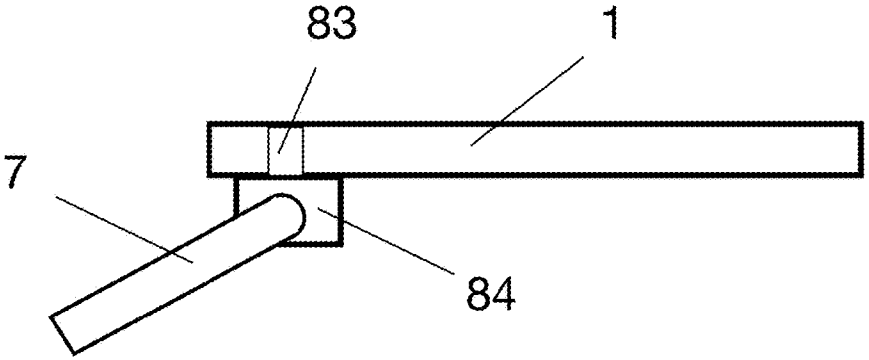
Figure 11I:
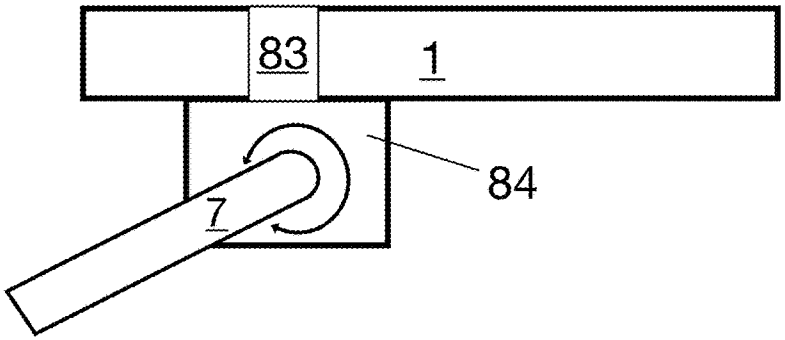
Figure 11J:
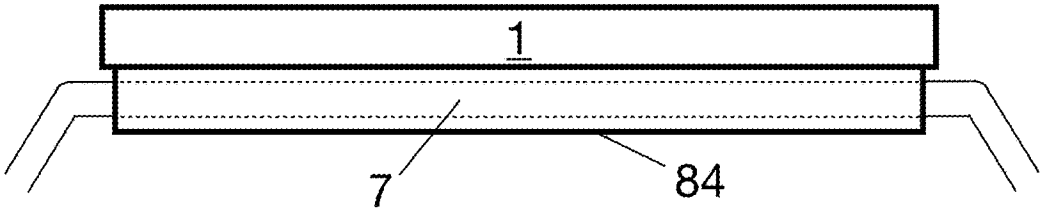
Figure 11K:
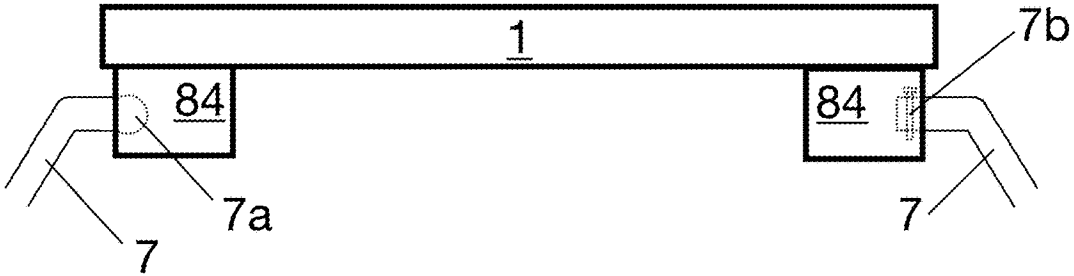

FIG. 11*f*-11*h*, illustrate another embodiment of the board system according to the present invention. In this embodiment, a retrofit kit is non-invasively coupled to an existing regular body board (1). In other words, there is minimum modification or no modification at all to the body board (1) in order to use the retrofit kit like the embodiments shown in FIGS. 7*a*, 7*b*, 9*a* and 9*b*. According to this embodiment, the retrofit kit includes left and right solid bars (7) with corresponding pivoting/rotation systems (84). In this embodiment, the solid bar (7) and the pivoting/rotation system (84) are provided separately as left and side units but it is also envisioned that they can be provided together as a single integral unit coupled to the board (1). The retrofit kit can be provided with either a single solid bar (7) and a single pivoting/rotation system (84), a single solid bar (7) and two separate pivoting/rotation systems (84), two separate solid bars (7) and a single pivoting/rotation system (84) or two separate solid bars (7) and two separate pivoting/rotation systems (84). On a basic configuration, the retrofit kit comprises a single solid bar (7) having a central and lateral portions where the central portion is contained inside a housing (FIG. 11*j*) so that the solid bar can freely rotate vertically inside said housing (FIG. 11*i*). Alternatively, two lateral solid bars (7) can be provided, wherein each solid bar (7) has rotating/pivoting end positioned inside a housing (FIG. 11*k*) that allows the solid bar to freely rotate and/or pivot inside said housing. In one embodiment, a rotating/pivoting end comprises a round end (7*a*) having a diameter greater than an opening on said housing so that the round end (7*a*) cannot fit thorough the opening while allowing rotation of the solid bar (7) as shown in FIG. 11*k*. Alternatively, a rotating/pivoting end comprises a pass-through opening receiving a locking pin (7*b*) so that the rotating/pivoting end is secured inside the housing while allowing rotation of the solid bar (7) as shown in FIG. 11*k*.

According to an embodiment of the invention, the spring element(s) (80) and/or the shock absorber/damper(s) (82) arrangement can be integrated into the housing to provide the same smooth damping and impact absorbing resistance as the embodiments shown in FIGS. 11*b*-11*e*.

The retrofit kit includes a strap (83) that allows the retrofit kit to be wrapped around the board (1) by its sides as shown in the Figures but can also be wrapped around the front and rear parts of the board (1), alone or in combination with the side strap (83). An adjustable lock/latch (85) is provided to fixedly secure the retrofit kit against the board (1) once the length of the strap (83) is adjusted around the board (1). As in previous embodiments, the retrofit kit is anchored to a surface via the cord (2), the elastic cord (8) or a combination of both. However, a spring mechanism and/or shock absorber/damper (as previously explained) can be incorporated with the retrofit kit. This can be done by incorporating the spring and/or shock absorber/damper mechanisms together with each pivoting/rotation systems (84) or with the single integral unit version previously explained. For the purpose of this description, the terms "elastic cord", "spring" and "shock absorber/damper" can be used interchangeably or defined altogether as an "elastic element" (8,82) to the extent that they are used to describe an element that counters a force exerted unto the solid bar (7) allowing movements of said solid bar (7) while returning said solid bar (7) towards its original position when the exerted force is removed or reduced.

Figure 12A:
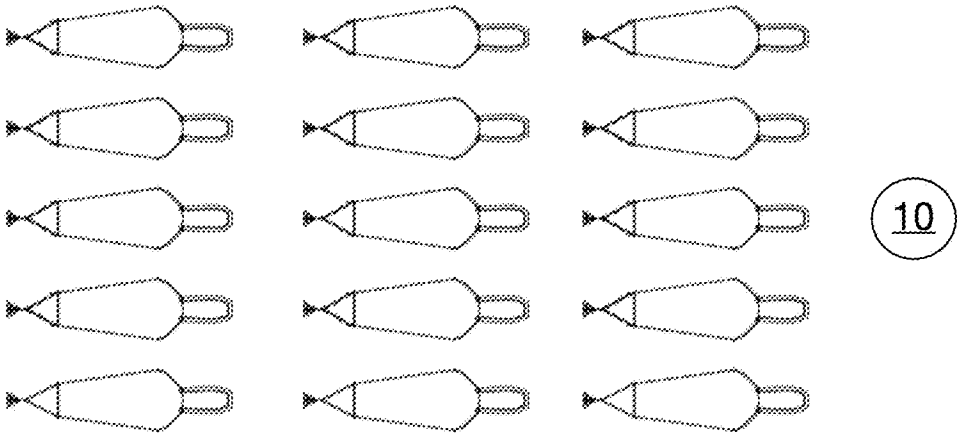
FIGS. 12*a*-12*b* illustrate an arrangement of plural body boards positioned for a multi-user session according to the present invention.
Figure 12B:
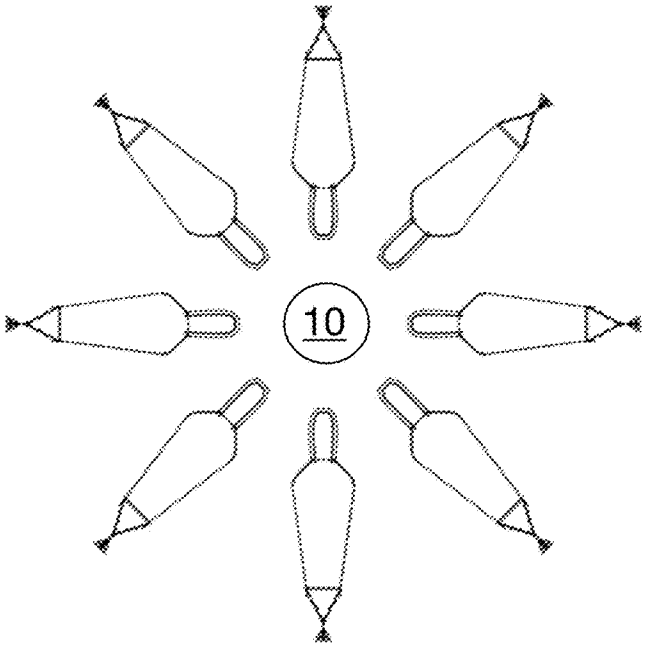

FIG. 12*a* and FIG. 12*b*, illustrate an arrangement of plural body boards (1) positioned for a multi-user session. The present invention can be used to teach or lead a plurality of people, each one using a board (1) of the invention. Specifically, an instructor or leader (10) is centrally positioned in relation to the group of boards (1). The plurality of boards (1) can be arranged in a linear configuration (FIG. 12*a*) where an instructor/leader (10) is positioned in front of the group or alternatively, the group of boards (1) can be positioned around the instructor/leader (10) in a round configuration (FIG. 12*b*). It is to be understood that any configuration and/or arrangement could be used according to the present invention.

The cord (2) can be made of nylon, thread, rope or any other material suitable to securely couple to components together. The elastic cord (8) can be an elastic bungee cord or a stretch resistance rubber band/cord. Alternatively, the elastic cord (8) can be replaced by a spring and/or a shock absorber/damper mechanism. Elastic cord (8) as well as any of its equivalent replacements can be provided in any location or position or can be coupled to any component of the board system as long as it provides the elastic/smooth resistance feature according to the present invention.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

The invention claimed is:

1. A bodyboard comprising:

a floating device having a user's body receiving surface; and at least one solid bar coupled to said floating device via a pivoting/rotation system that allows said at least one solid bar to pivot in relation to said floating device in a vertical direction.

2. The bodyboard of claim 1, wherein said at least one solid bar rotates horizontally in relation to said floating device.

3. The bodyboard of claim 1, wherein said at least one solid bar comprises a single bar having a middle section and lateral ends protruding from sides of said floating device.

4. The bodyboard of claim 1, wherein said at least one solid bar comprises a left-side bar and a separate right-side bar, each one protruding from respective sides of said floating device.

5. The bodyboard of claim 3, wherein said middle section is enclosed inside said floating device.

6. The bodyboard of claim 5, wherein said middle section rotates inside said floating device.

7. The bodyboard of claim 4, wherein a rotating end of said left-side bar and said separate right-side bar is coupled to said floating device.

8. The bodyboard of claim 7, wherein each rotating end rotates inside said floating device.

9. The bodyboard of claim 1, wherein said at least one solid bar is coupled to said floating device by one of a screw, a ball joint arrangement, a suction element, a pair of magnetic elements, a clamp element, or a passthrough element with a shackle portion.

10. The bodyboard of claim 1, further comprising an elastic element coupled to said at least one solid bar.

11. The bodyboard of claim 10, wherein said elastic element comprises an elastic cord.

12. The bodyboard of claim 10, wherein said elastic element comprises at least one spring element.

13. The bodyboard of claim 10, wherein said elastic element comprises at least one shock absorber/damper element.

14. The bodyboard of claim 7, wherein at least one of the rotating ends of said left-side bar and said separate right-side bar has a round shape with a diameter greater than an opening on said floating device securing said rotating end inside said floating device.

15. The bodyboard of claim 7, wherein at least one of the rotating ends of said left-side bar and said separate right-side bar comprises a pass-through opening and a locking pin inserted through said pass-through opening securing said rotating end inside said floating device.

16. The bodyboard of claim 7, wherein at least one of the rotating ends of said left-side bar and said separate right-side bar has a round shape with a diameter greater than an opening on an external housing of said floating device securing said rotating end inside said housing.

17. The bodyboard of claim 7, wherein at least one of the rotating ends of said left-side bar and said separate right-side bar comprises a pass-through opening and a locking pin inserted through said pass-through opening securing said rotating end inside an external housing of said floating device.

18. The bodyboard of claim 1, wherein said at least one solid bar comprises a plurality of bars removably coupled together.

19. The bodyboard of claim 2, wherein said at least one solid bar rotates within an angular limited range $\alpha$.

20. The bodyboard of claim 19, wherein said angular limited range is defined by at least one detent stopping angular movement of said at least one solid bar.

21. A The body board system comprising:

a floating device having a user's body receiving surface;

a pair of lateral solid bars coupled to and extending away from said floating device, via a pivoting/rotation system that allows said pair of lateral solid bars to rotate in relation to said floating device in a vertical direction; and an anchoring system securing said floating device to a surface, wherein at least one elastic element is coupled to between at least one lateral solid bar of the pair of lateral solid bars and said anchoring system.

22. The body board system of claim 21, wherein said pair of lateral solid bars comprise a single bar having a middle bar section and lateral ends extending away from the sides of said floating device.

23. The body board system of claim 21, wherein said pair of lateral solid bars comprise a left-side bar and a separate right-side bar, each one extending away from the sides of said floating device.

24. The body board system of claim 21, further comprising a pair of lateral cords coupling said pair of lateral solid bars to said anchoring system, respectively.

25. The body board system of claim 24, further comprising a spacing bar maintaining said pair of lateral cords separated from each other.

26. The body board system of claim 25, wherein said at least one elastic element is coupled to said spacing bar.

27. The body board system of claim 24, wherein said pair of lateral cords are made from an elastic material.

28. The body board system of claim 21, wherein said at least one elastic element comprises: an elastic cord, a spring element, or a shock absorber/damper.

29. The body board system of claim 21, wherein said pair of lateral solid bars is coupled to said floating device by: a removable strap, a suction element, a magnetic element, or a screw.

30. The body board system of claim 21, wherein said pair of lateral solid bars rotates within an angular limited range $\alpha$.

31. The body board system of claim 30, wherein said angular limited range $\alpha$ is defined by at least one detent stopping angular movement of said pair of lateral solid bars.

* * * * *